US006644501B2

(12) United States Patent
Iida

(10) Patent No.: US 6,644,501 B2
(45) Date of Patent: Nov. 11, 2003

(54) SHEET PACKAGE

(75) Inventor: Yukiko Iida, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 10/007,577

(22) Filed: Dec. 5, 2001

(65) Prior Publication Data

US 2002/0070141 A1 Jun. 13, 2002

(30) Foreign Application Priority Data

Dec. 8, 2000 (JP) ..... 2000-373688

(51) Int. Cl.[7] ..... A47K 10/24
(52) U.S. Cl. ..... 221/48; 221/49; 428/126
(58) Field of Search ..... 221/38, 47, 48, 221/49; 428/126, 130, 131, 134, 135, 136

(56) References Cited

U.S. PATENT DOCUMENTS 1,675,700 A 7/1928 Fairchild
3,119,516 A 1/1964 Donovan
4,913,311 A 4/1990 Garcia ..... 221/22
5,118,554 A 6/1992 Chan et al. ..... 428/126

FOREIGN PATENT DOCUMENTS

EP 0945092 9/1999 ..... A47G/11/00

*Primary Examiner*—David H. Bollinger
(74) *Attorney, Agent, or Firm*—Darby & Darby

(57) ABSTRACT

A sheet package can prevent a sheet from causing damage upon dispensing the sheet through a dispensing opening without widening an opening width of the dispensing opening and providing extra gap within a package container. The sheet package includes a sheet stack, in which a plurality of folded sheets are stacked, received within a package container with a dispensing opening. Each individual sheet is folded into two-ply sheet along a first folding line, two sheets of the two-ply sheet are folded along a second folding line extending in parallel to the first folding line together for forming a folded sheet, a plurality of folded sheets are stacked in such a manner that a portion including the first folding line of a lower folded sheet is disposed within a valley folded portion of an upper folded sheet.

10 Claims, 7 Drawing Sheets

SHEET PACKAGE

BACKGROUND OF THE INVENTION

1. Field of the Invention

The present invention relates to a sheet package housing a sheet stack in which a plurality of sheets are stacked, received within a package container having a dispensing opening.

2. Description of the Related Art

Some of sheets for hand cleaning, baby wipes or sheets for cleaning toilet, kitchen and so forth are provided as wet type sheet. Such wet type sheets are sealingly received within a package container, such as a hard packaging vessel and a bag formed of a packaging sheet in order to maintain wet condition. The package container is formed with a dispensing opening so as to permit sequential dispensing of the sheets. On the other hand, this kind of sheets are so combined as to link vertically adjacent sheets with each other, so that next sheet is drawn together with the uppermost sheet to project the upper portion thereof through the dispensing opening when the uppermost sheet is pulled out.

Such type of the sheet package is typically called as pop-up type. Prior art of a sheet stack of the wet type sheet as pop-up type will be discussed with reference to FIGS. 6 and 7.

The sheet stack shown in FIG. 6 is formed by stacking a plurality of folded sheets 80 combined with each other. Each sheet 80 is folded in a folding line 81 to form an upper piece 82 and a lower piece 83. The odd number order sheets 80 and the even number order sheets 80 are combined symmetrically with each other. Between the upper piece 82 and the lower piece 83 of the upper sheet (or the overlying sheet), the upper piece 82 of the lower sheet (or the underlying sheet) is disposed. An overlapping width between the lower piece 83 of the upper sheet and the upper piece 82 of the lower sheet are set in an extent of 30 mm, for example. The lower piece 83 and the upper piece 82 are joined by a water screen.

The sheet stack is housed within a package container 100, such as a hard packaging vessel, a packaging bag or the like, provided with a dispensing opening 100*a*. Pinching the upper piece 82 of the upper sheet with fingers and pulling out the same through the dispensing opening 100*a*, the lower sheet is drawn at the upper piece by the lower piece of the upper sheet. Then, due to resistance at the edge portion of the dispensing opening 100*a*, joining between the upper sheet and the lower sheet by the water screen is broken to separate the upper sheet and the lower sheet. As a result, the upper piece 82 of the lower sheet is projected from the dispensing opening 100*a* to facilitate dispensing of the next sheet.

Each sheet 90 in the sheet stack shown in FIG. 7 is folded in such a manner that an upper piece 91 is placed at upper side of an intermediate piece 93 and a lower piece 92 is placed at lower side of the intermediate piece 93. Thus, the sheet 90 is folded into substantially Z-shape.

In the sheet stack, the upper piece 91 of the lower sheet is disposed between the intermediate piece 93 and the lower piece 92 of the upper sheet. When the upper piece 91 of the upper sheet is drawn out through the dispensing opening 100*a* of the package container 100, the upper piece 91 of the lower sheet is trained (or dragged) together with the lower piece 92 of the upper sheet to be drawn out through the dispensing opening 100*a* to project therefrom.

However, in the sheet stacks shown in FIGS. 6 and 7, the lower sheet is drawn out to project from the dispensing opening 100*a* when the upper sheet is dispensed through the dispensing opening 100*a*. For separating the lower sheet from the upper sheet as trained, a resistance force is exerted on the upper piece 82 projecting through the dispensing opening 100*a* in case of the sheet stack shown in FIG. 6. On the other hand, the resistance force is exerted on the upper piece 91 projecting through the dispensing opening 100*a* in case of the sheet stack shown in FIG. 7.

Therefore, in the case where strength of each sheet is low in dispensing direction, when the upper piece 82 or 91 projecting from the dispensing opening 100*a* is drawn out with pinching by fingers, the sheet may be broken at the mid-way of dispensing due to sliding resistance between the edge portion of the dispensing opening 100*a* and the sheet, or the sheet may be damaged to be locally become thin due to separation between the fibers.

Particularly, when the sheets in the package container 100 is in wet condition, strength of each sheet becomes low. Furthermore, when the sheet 80 or 90 is water-decomposable sheet to be dispersed in large amount of water as disposed into flush toilet after use, the breaking strength in dispensing direction is typically less than or equal to 4.9N per 25 mm width in wet condition. Therefore, the water-decomposable sheet can be damaged by resistance as being dispensed through the dispensing opening 100*a*.

For preventing damage to the sheet dispensed as a single sheet as set forth above, an inner width W100 of the dispensing opening 100*a* is required to be widened to reduce sliding resistance to be exerted on the sheet from the edge portion of the dispensing opening 100*a*. However, when the inner width W100 of the dispensing opening 100*a* becomes excessively wide, the sheets within the package container 100 in wet condition can be easily dried. Also, since a cover member closing the dispensing opening 100*a* becomes excessively large to cause difficulty in certainly adhering the cover member in the circumference of the dispensing opening 100*a* when the dispensing opening 100*a* is covered by the cover member. If closure of the dispensing opening 100*a* by the cover member is incomplete, the sheet can be easily dried.

On the other hand, when number of sheets to be received is smaller as compared with a volume of the package container and when a slight gap is formed between the uppermost sheet and the dispensing opening, resistance to be exerted as dispensing uppermost several sheets becomes smaller. However, in this case, excessive size of the package container becomes necessary as compared with the sheet stack. On the other hand, when the package container is formed with a packaging sheet, the package container is formed by wrapping the sheet stack with the packaging sheet. At this time, it is difficult to continuously and automatically perform operation for packing the sheet stack with maintaining a gap (space) within the package container.

SUMMARY OF THE INVENTION

The present invention has been worked out in view of the problems in the prior art as set forth above. It is therefore an object of the present invention to provide a sheet package which can prevent from causing damage to a sheet upon dispensing the sheet through a dispensing opening without widening an opening width of the dispensing opening and providing extra gap within a package container.

According to the first aspect of the present invention, a sheet package includes a sheet stack, in which a plurality of folded sheets are stacked, received within a package container with a dispensing opening, wherein each individual sheet is folded into two-ply sheet along a first folding line, two sheets of the two-ply sheet are folded along a second folding line extending in parallel to the first folding line together for forming a folded sheet, a plurality of folded sheets are stacked in such a manner that a portion including the first folding line of a lower folded sheet is disposed within a valley folded portion of an upper folded sheet.

The sheet stack may be formed with placing the first folding line of each folded sheet with a width range of the dispensing opening. The sheet may be a water decomposable sheet disposed within the package container in wet condition, the two-ply sheet may have a breaking strength less than or equal to 9.8N per 25 mm width in wet condition in a direction perpendicular to the first folding line. The folded sheets in the sheet stack may include first folded sheets oriented in one direction and second folded sheets oriented in the other direction, the first and second folded sheets may be stacked alternately in such a manner the portion including the first folding line of one of the first and second folded sheet located at lower side may be disposed within the valley folded portion of the other of the first and second folded sheet located at upper side. In the preferred construction, the portion including the first folding line of one of the first and second folded sheets located at lower side and the portion including the first folding line of the other of the first and second folded sheet located at upper side do not overlap with each other on a center line extending in sheet stacking direction. The two-ply sheet may be formed by folding an essentially rectangular flat one-ply sheet at the first folding line inclined to one of opposite shorter edges so that shorter edges of the two-ply sheet as folded along the first folding line are offset from each other, and two sheet fractions continuous across the first folding line for forming the two-ply sheet have mutually different length in a direction perpendicular to a direction along which the first folding line extends, one of the sheet fraction having shorter length of the first and second folded sheets do not overlap with each other as stacked.

According to the second aspect of the present invention, a sheet package comprises:

a package container defining a sheet stack receptacle space and a dispensing opening communicated with the sheet stack receptacle space; and a sheet stack containing a plurality of sheets, each individual sheets being two-ply sheet consisted of two sheet fractions continuous across a first folding line, a plurality of the two-ply sheets being interfolded with each other in such a manner that when an uppermost sheet is withdrawn through the dispensing opening, a succeeding sheet follows and is separated at the dispensing opening to be retained projecting a portion including the first folding line from the dispensing opening so that portion of the sheet in two-ply structure is constantly gripped as withdrawn from the package container.

According to the third aspect of the present invention, sheet package comprising:

a package container defining a sheet stack receptacle space and a dispensing opening communicated with the sheet stack receptacle space; and a sheet stack containing a plurality of sheets, each individual sheets being two-ply sheet consisted of two sheet fractions continuous across a first folding line, a plurality of the two-ply sheets being interfolded with each other in such a manner that when an uppermost sheet is withdrawn through the dispensing opening, a succeeding sheet follows and is separated at the dispensing opening to be retained projecting a leading edge including the first folding line from the dispensing opening so that portion of the sheet in two-ply structure is constantly gripped as withdrawn from the package container, the leading edges of vertically adjacent sheets being arranged in non-overlapping manner.

According to the fourth aspect of the present invention, a sheet stack for a sheet package comprises a plurality of sheets, each individual sheets being two-ply sheet consisted of two sheet fractions continuous across a first folding line, a plurality of the two-ply sheets being interfolded with each other in such a manner that vertically adjacent sheets being interlinked at a trailing end portion of an upper sheet and a leading end portion of a lower sheet, so that the lower sheet is placed in a position ready for dispensing after dispensing the upper sheet, and the leading end portion includes a leading edge along which the first folding line extends.

According to the fifth aspect of the present invention, a sheet stack for a sheet package comprises a plurality of sheets, each individual sheets being two-ply sheet consisted of two sheet fractions continuous across a first folding line, a plurality of the two-ply sheets being interfolded with each other in such a manner that vertically adjacent sheets being interlinked at a trailing end portion of an upper sheet and a leading end portion of a lower sheet, so that the lower sheet is placed in a position ready for dispensing after dispensing the upper sheet, and the leading end portion includes a leading edge along which the first folding line extends, and the leading end portions of vertically adjacent sheets being arranged in non-overlapping manner.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure is not shown in detail in order to avoid unnecessary obscurity of the present invention.

Figure 1:
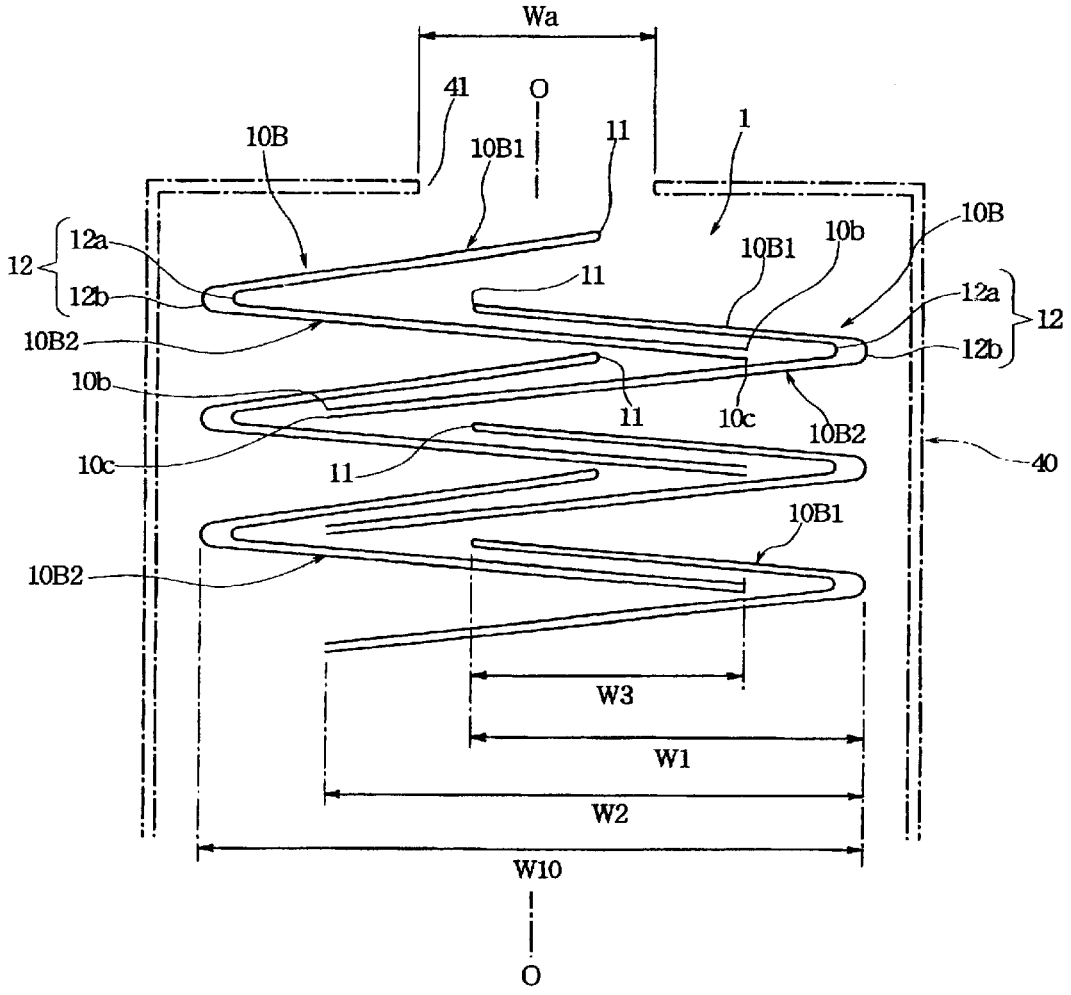
FIG. 1 is a section of the first embodiment of a sheet package according to the present invention.
Figure 2A:
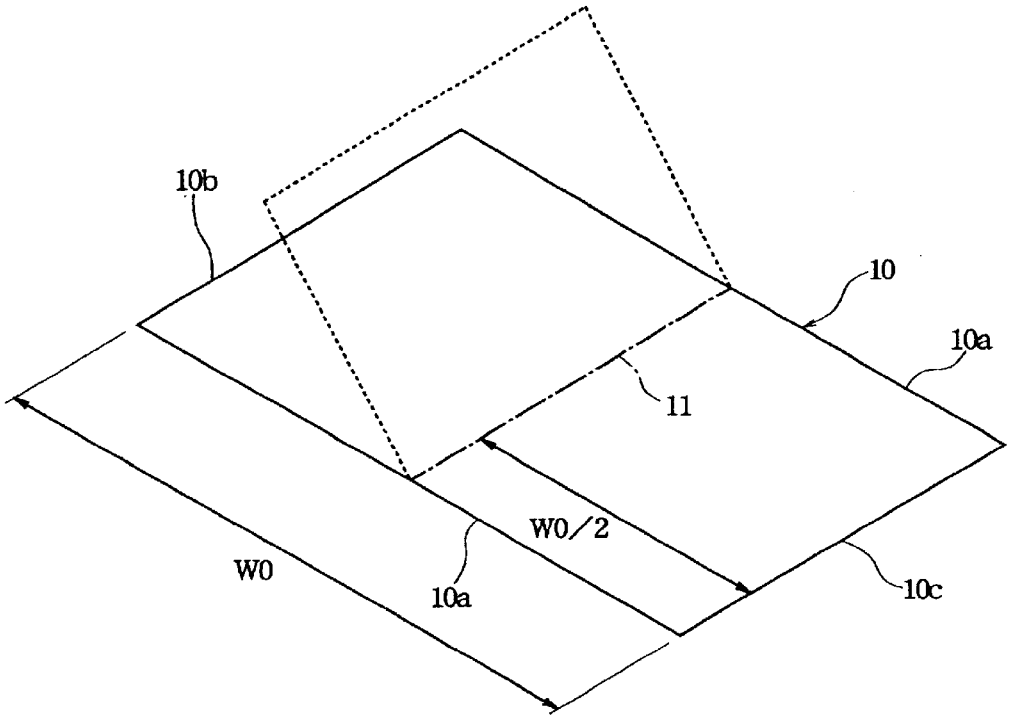
FIGS. 2A and 2B are perspective views showing manner of folding of an individual sheet forming the first embodiment of a sheet stack.
Figure 2B:
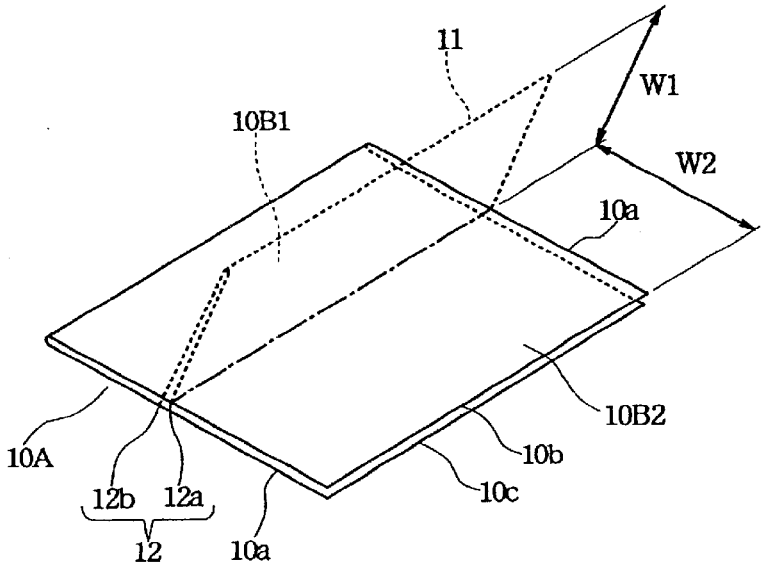

FIG. 1 is a section of the first embodiment of a sheet package according to the present invention, and FIGS. 2A and 2B are perspective views showing manner of folding of an individual sheet forming the first embodiment of a sheet stack.

In the sheet package shown in FIG. 1, a sheet stack 1 is received within a package container 40. The package container 40 may be a hard packaging vessel formed of a plastic material or a packaging bag formed of a laminated material of a soft packaging sheet, such as a resin film and an aluminum foil and so forth. On the other hand, it is also possible that the packaging bag containing the sheet stack is used as received within the hard packaging vessel. In an upper portion (upper surface) of the package container 40, a dispensing opening 41 is formed.

In the sheet stack 1, each individual sheet 10 is folded into four plies as shown in FIGS. 2A and 2B. The individual sheets 10 are stacked in such a manner that when the sheet 10 on upper side is dispensed from the dispensing opening 41, the lower sheet 10 is pulled up together with the upper sheet. As can be seen from FIG. 1, the individual sheets 10 are folded into V-shape as V folded sheet.

As shown in FIG. 2A, each individual sheet 10 is originally rectangular shape having longer edges 10*a* and shorter edges 10*b* and 10*c*. The sheet 10 is folded at a first folding line 11 parallel to the shorter edges 10*b* and 10*c* to form a two-ply sheet 10A. In the embodiment shown in FIGS. 1, 2A and 2B, distances between the first folding line 11 and the shorter edges 10*b* and 11*c* become half or substantially half of a length W0 of the longer edge 10*a*. Therefore, as folded into the two-ply sheet 10A, the shorter edges 10*b* and 10*c* mate with each other, and an area of the folded two-ply sheet 10A shown in FIG. 2B is half or substantially half of that of the original sheet 10 shown in FIG. 2A.

As shown in FIG. 2B, the two-ply sheet 10A is further folded at a second folding line 12 extending in parallel to the first folding line 11 to form a four-ply V-folded sheet 10B. At the second folding line 12, an inner half sheet of the two-ply sheet 10A is valley folded at an inner folding line 12*a* and an outer half sheet of the two-ply sheet 10A is mountain folded at an outer folding line 12*b*. In other words, when the two-ply folded sheet 10A is folded into the four-ply V-folded sheet 10B, the inner half sheet and the outer half sheet are folded together at respective inner and outer folding lines 12*a* and 12*b*.

As shown in FIG. 1, the four-ply V-folded sheet 10B is folded into V-shape at the second folding line 12 to form an upper piece 10B1 and a lower piece 10B2. Each of the upper piece 10B1 and the lower piece 10B2 are respectively in two-ply sheet structure.

In case of the sheet stack 1 shown in FIG. 1, the four-ply V-folded sheet 10B as folded along the second folding line 12 defines a valley folded portion between a lower surface of the upper piece 10B1 and an upper surface of the lower piece 10B2 as folded along the inner folding line 12*a*. In the valley folded portion of one four-ply V-folded sheet 10B, the upper piece 10B1 of the next lower four-ply V-folded sheet 10B with the folded edge along the first folding line 11 is placed. Thus, the upper piece 10B1 of the next lower four-ply V-folded sheet 10B is disposed between the upper and lower pieces 10B1 and 10B2 of one four-ply V-folded sheet 10B. The upper surface of the lower piece 10B2 overlaps with the upper piece 10B1 of the next lower four-ply V-folded sheet 10B with an overlapping width W3.

In the sheet stack 1, the four-ply V-folded sheets 10B are oriented alternately. In the embodiment shown in FIG. 1, one four-ply V-folded sheet 10B is oriented with placing the folded edge along the second folding line 12 at left side, and the other and next lower four-ply V-shaped sheet 10B is oriented with placing the folded edge along the second folding line 12 at right side. The first mentioned four-ply V-folded sheet, i.e. one four-ply V-folded sheet 10B will be hereinafter referred to as first four-ply V-folded sheet and the second mentioned four-ply V-folded sheet, i.e. the other four-ply V-folded sheet 10B will be hereinafter referred to as second four-ply V-folded sheet. The first and second four-ply V-folded sheets are combined alternately in laterally symmetrical fashion. The sheet stack 10B thus formed has a width W10 between the folded portions at the folding lines 12.

With respect to a center line O—O extending in sheet stacking direction at a position half of the width W10, the folded portions along the first folding lines 11 in the first and second four-ply V-folded sheets 10B are located close to the center line O—O so that the folded portion along the first folding line 11, namely a tip end of the upper piece 10B1 of the four-ply V-folded sheet always falls within an area of the dispensing opening 41 of the width Wa when the sheet is dispensed through the dispensing opening 41 in order.

In the sheet package shown in FIG. 1, since the tip end of the upper piece 10B1 of the four-ply V-folded sheet 10B is exposed through the dispensing opening 41, the two-ply sheet is gripped by fingers at the tip end along the first folding line 11 to be pulled up for dispensing. When each sheet is in a condition impregnated by water or chemical solution (i.e., wet condition), the lower piece 10B2 of the four-ply V-folded sheet to be withdrawn and the upper piece 10B1 of the next lower four-ply V-folded sheet are tightly fitted by the water screen.

Therefore, when the uppermost four-ply V-folded sheet is withdrawn from the dispensing opening 41, the next lower four-ply V-folded sheet is pulled up together with the uppermost four-ply V-folded sheet to project from the dispensing opening 41. Then, by exerting a resistance force on the next lower four-ply V-folded sheet being pulled out from the edge portion of the dispensing opening 41, the uppermost sheet being withdrawn or dispensed and the next lower sheet joined at the mating portions of the width W3 are separated. Then, the upper piece 10B1 of the next lower sheet is held in slightly projecting condition from the dispensing opening 41. Therefore, at the next time, the sheet projecting from the dispensing opening 41 can be gripped and withdrawn through the dispensing opening 41.

In the condition retained in the dispensing opening 41 after dispensing the preceding sheet, the tip end as folded along the first folding line 11 is oriented upwardly. On the other hand, since the two-ply sheets are folded together at the second folding line 12 (at the inner folding line 12*a* and the outer folding line 12*b*), the entire upper piece 10B1 has two-ply structure. When the next lower sheet is pulled following the uppermost sheet to project from the dispensing opening 41, the upper piece 10B1 primarily receives the resistance force from the edge portion of the dispensing opening 41. Since the upper piece 10B1 is two-ply sheet structure, the strength of the upper piece 10B1 is sufficiently high to prevent from causing rupture or damage due to resistance.

Therefore, even if the sheet per se has low wet strength, the sheet may hardly cause rupture or damage, such as expansion of gap between the fibers or so forth, due to sliding resistance of the dispensing opening 41. For example, the sheet 10 may be water decomposable sheet having low wet strength. The water decomposable sheet may be decomposed by dispersing fibers with a large amount of water as disposed into a flush toilet. For example, the water decomposable sheet may be a paper or non-woven fabric made of fibers such as rayon or pulp and containing water decomposable or water-swelling binder such as CMC (carboxymethyl cellulose); or non-woven fabric fabricated by entangling fibers such as rayon or the like of fiber length shorter than or equal to 10 mm or shorter than or equal to 7 mm by water-jetting treatment, so that the entangled short fibers having fiber length shorter than or equal to 10 mm are separated and dispersed as applied a large amount of water. In the alternative, the water decomposable sheet may be a paper or non-woven fabric containing fibrillated rayon in rayon or pulp, in which the fibrillated rayon acts as binder.

Typical water-decomposable sheet in wet condition has a breaking strength less than or equal to 4.9N per 25 mm width in a direction of withdrawing the sheet through the dispensing opening 41 (i.e., the dispensing direction), as one-ply sheet. Even with such sheet having low breaking strength, the sheet package of the present invention can be embodied with avoiding the problem to be damaged by the resistance to be exerted by the edge portion of the dispensing opening 41. It should be noted that the breaking strength herein referred to is expressed by a tension load upon occurrence of rupture on a test sample of 25 mm width and 150 mm length as subject to tensile test by impregnating with moisture of 2.5 times of a weight of the sheet (i.e., the test sample), chucking between chucks of Tensilon Tester at an initial distance of 100 mm, and applying a tension between the chucks at a speed of 100 mm/min.

In the embodiment shown in FIGS. 1, 2A and 2B, a length W0 of the longer edge 10*a* of the sheet 10 is 190 mm, a length W0/2 of the two-ply sheet 10A as folded along the first folding line 11 is 95 mm, a length W1 of the upper piece 10B1 is 40 mm and a length W2 of the lower piece 10B2 is 55 mm, for example. Assuming that the overlapping width W3 of the upper piece 10B1 and the lower piece 10B2 of adjacent first and second four-ply V-folded sheets is 30 mm, the width W10 of the sheet stack 1 becomes 65 mm.

It should be noted that the overlapping width W3 between the sheets in wet condition is preferably in a range of 20 to 40 mm. With this overlapping range, when the uppermost sheet is dispensed from the dispensing opening 41, the next lower sheet may follow withdrawal of the uppermost sheet, and can be separated from the uppermost sheet by the resistance force exerted by the dispensing opening 41. Then, the upper piece of the next lower sheet may project from the dispensing opening 41 with an appropriate projection amount.

Figure 3:
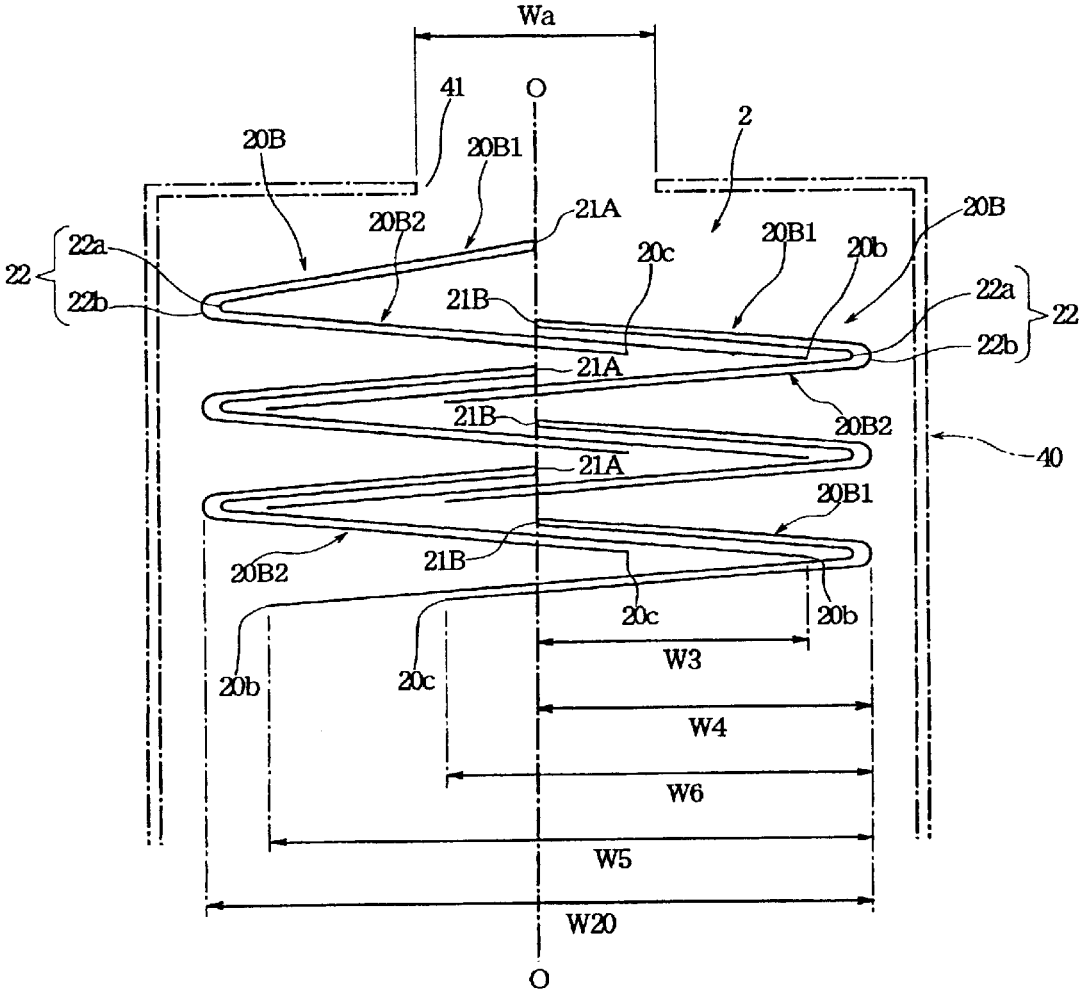
FIG. 3 is a section of the second embodiment of the sheet package according to the present invention.
Figure 4A:
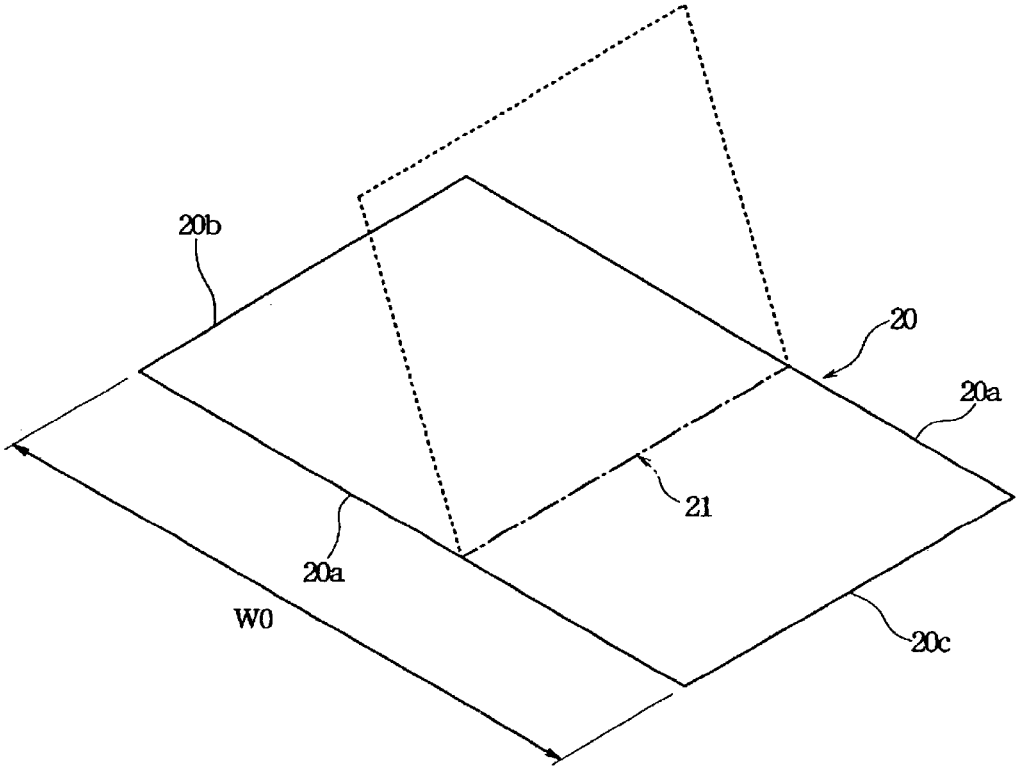
FIGS. 4A and 4B are perspective views showing manner of folding of an individual sheet forming the second embodiment of the sheet stack.
Figure 4B:
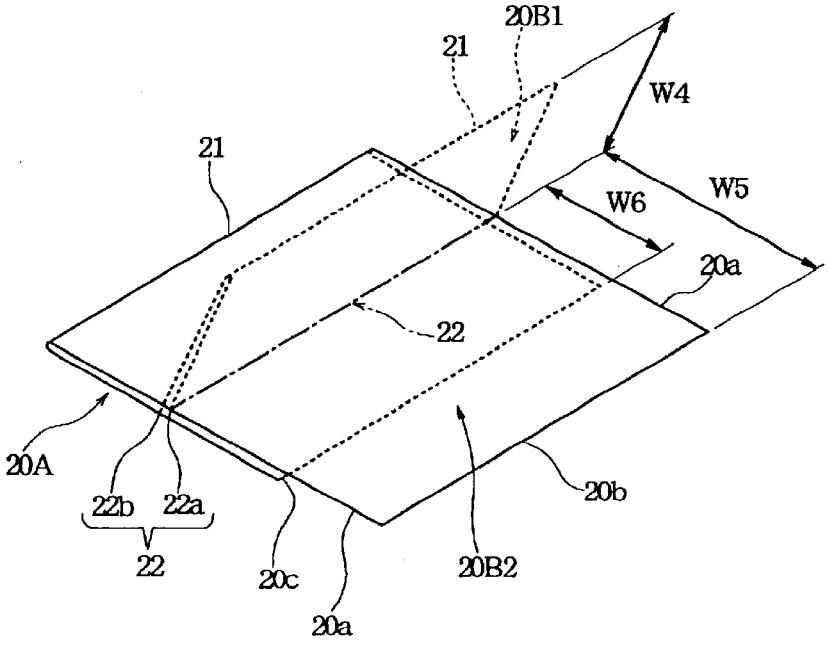

FIG. 3 is a section of the second embodiment of the sheet package according to the present invention, and FIGS. 4A and 4B are perspective views showing manner of folding of an individual sheet forming the second embodiment of the sheet stack.

The sheet package shown in FIG. 3 is formed by disposing a sheet stack 2 within the package container 40. In the shown embodiment, each individual sheet 20 forming the sheet stack 2 in developed condition has rectangular shape having longer edges 20*a* and shorter edges 20*b* and 20*c*, as shown in FIG. 4A.

As shown in FIG. 4A, the sheet 20 is folded into a two-ply sheet 20A along a first folding line 21 parallel to the shorter edges 20*b* and 20*c*. The first folding line 21 is formed at a position inclined toward one shorter edge 20*c* from a center position of a length W0 of the longer edge 20*a*. Therefore, as shown in FIG. 4B, one shorter edge 20*c* is located at closer position to the first folding line 21 than the other shorter edge 20*b*. Thus, the shorter edges 20*b* and 20*c* are offset with each other.

As shown in FIG. 4B, the two-ply sheet 20A is further folded along a second folding line 22 extending in parallel to the first folding line 21. The second folding line 22 is set at a position having two-ply structure. Accordingly, the second folding line 22 is consisted of an inner folding line 22*a* on one sheet fraction located at inner side and an outer folding line 22*b* on the other sheet fraction located at outer side, continuous with the one sheet fraction across the first folding line 21 and thus forming the two-ply sheet 20A together with one sheet fraction. Two sheet fractions of the two-ply sheet 20A are folded together at respective inner and outer folding lines 22*a* and 22*b* to form a four-ply V-folded sheet 20B.

In the sheet stack 2 shown in FIG. 3, similarly to the former embodiment, first four-ply V-folded sheets 20B and second four-ply V-folded sheets 20B respectively folded in mutually opposite directions. In the sheet stack 2, the first and second four-ply V-folded sheets 20B are alternately stacked in laterally symmetrical fashion with placing the sheet fraction having the shorter edges 20*b* inner side.

In case of the sheet stack 2 shown in FIG. 3, the four-ply V-folded sheet 20B as folded along the second folding line 22 defines a valley folded portion between the lower surface of an upper piece 20B1 and the upper surface of a lower piece 20B2 as folded along the inner folding line 22*a*. In the valley folded portion of one four-ply folded sheet 20B, the upper piece 20B1 of the next lower four-ply V-folded sheet 20B with the folded edge along the first folding line 21 is placed. Thus, the upper piece 20B1 of the next lower four-ply V-folded sheet 20B is disposed between the upper and lower pieces 20B1 and 20B2 of one four-ply V-folded sheet 20B.

In the sheet stack 2, the first folding line 21 (21A) of the first four-ply V-folded sheet 20B and the first folding line 21 (21B) of the second four-ply V-folded sheet 20B are placed on the center line O—O extending in sheet stacking direction without overlapping with each other. While the shown embodiment is illustrated in a form where the first folding line 21 (21A) of the first four-ply V-folded sheet 20B and the first folding line 21 (21B) of the second four-ply V-folded sheet 20B are placed on the center line O—O, it is also possible to combine the first and second four-ply V-folded sheets 20B with placing the first folding line 21 (21A) on left side of the center line O—O in FIG. 3, and placing the first folding line 21 (21B) on right side of the center line O—O in FIG. 3.

Therefore, the upper pieces 20B1 of the first and second four-ply V-folded sheets 20B in two-ply structure do not overlap as stacking alternately the first and second four-ply V-folded sheets 20B for avoiding increasing of thickness due to overlapping of the upper pieces 20B1. This prevents thickening of the sheet stack 2 at the center portion. On the other hand, since the first folding lines 21 (21A, 21B) of respective sheets are located substantially center of the dispensing opening 41 having the width Wa, even if the upper piece 20B1 of the next lower sheet fails to follow the uppermost sheet as disposed, the upper edge of the upper piece 20B1 along the first folding line 21 placed inside of the package container 40 can be easily withdrawn through the dispensing opening 41.

Even in the shown embodiment, when resistance is exerted on the upper piece 20B1 of the two-ply structure from the edge portion of the dispensing opening 41 upon dispensing the sheet, the sheet is hardly damaged even though one-ply sheet has low wet strength.

In the embodiment shown in FIGS. 3, 4A and 4B, a length W0 of the longer edge 20*a* of the sheet 20 is 190 mm in developed condition, a length W4 of the upper piece 20B1 between the first folding line 21 and the second folding line 22 is 37.5 mm, a length W5 from the second folding line 22 to one shorter edge 20*b* is 67.5 mm, and a length W6 from the second folding line 22 to the other shorter edge 20*c* is 47.5 mm, for example. In this case, assuming that the overlapping width W3 of the upper piece 20B1 and the lower piece 20B2 of adjacent first and second four-ply V-folded sheets is 30 mm, the width W20 of the sheet stack 2 becomes 75 mm.

Figure 5:
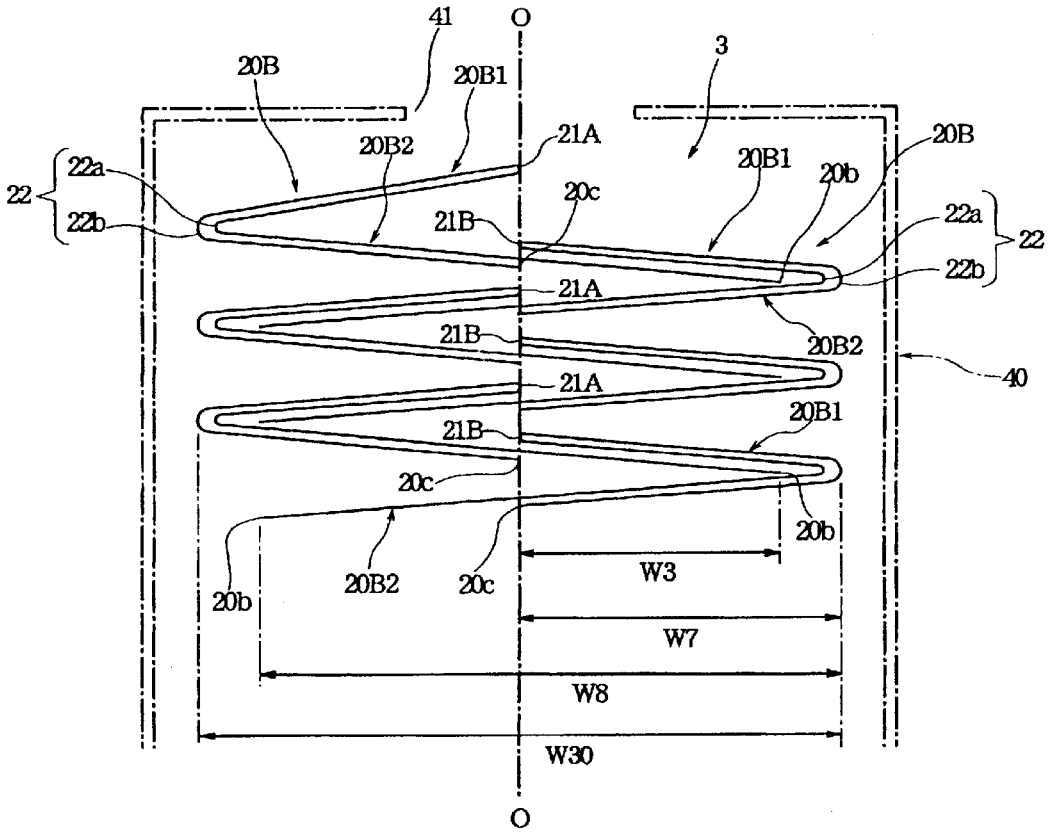
FIG. 5 is a section showing a more preferred modification of the second embodiment of the sheet package according to the present invention.
Figure 6:
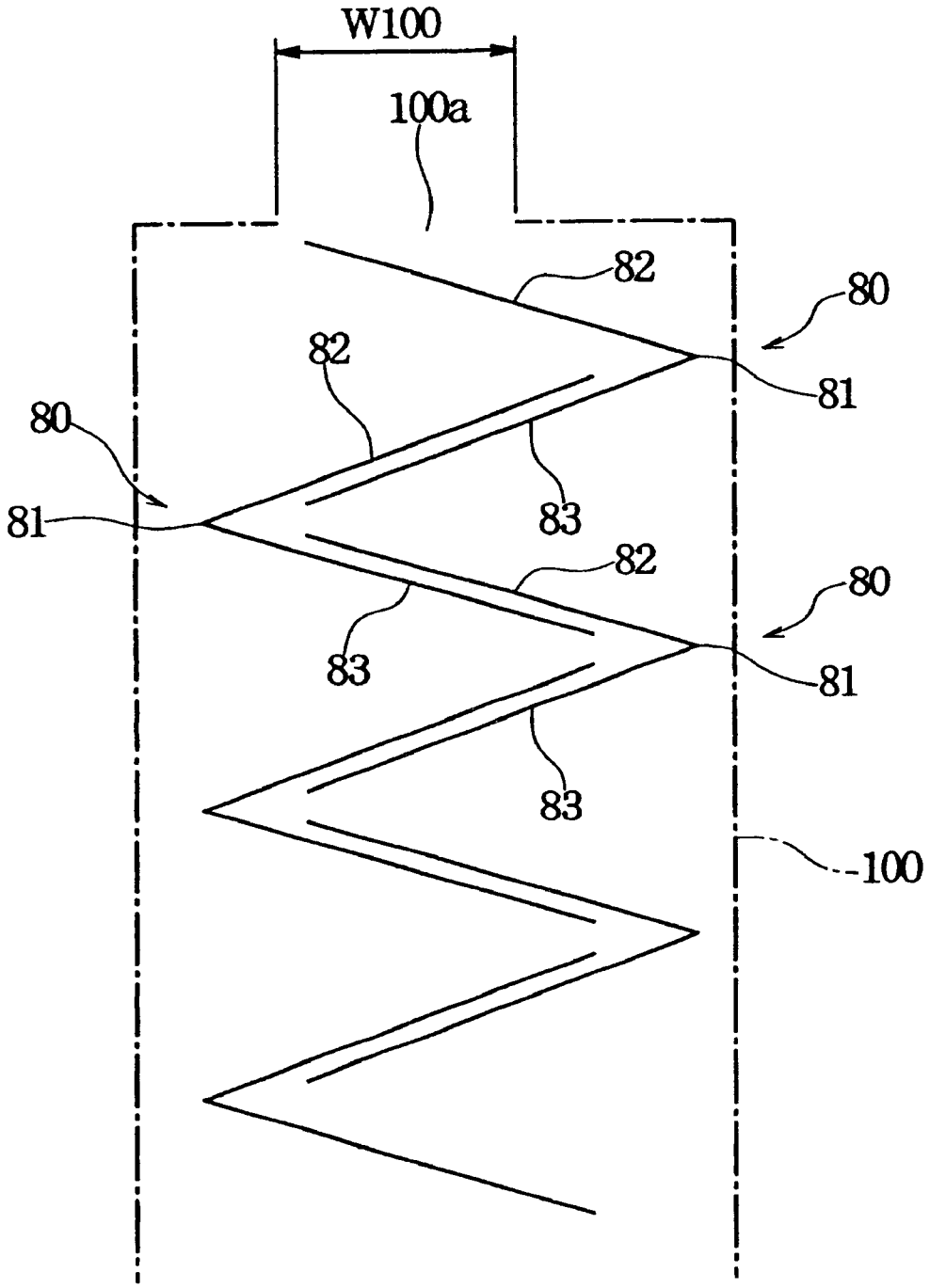
FIG. 6 is a section for explaining one conventional sheet package.
Figure 7:
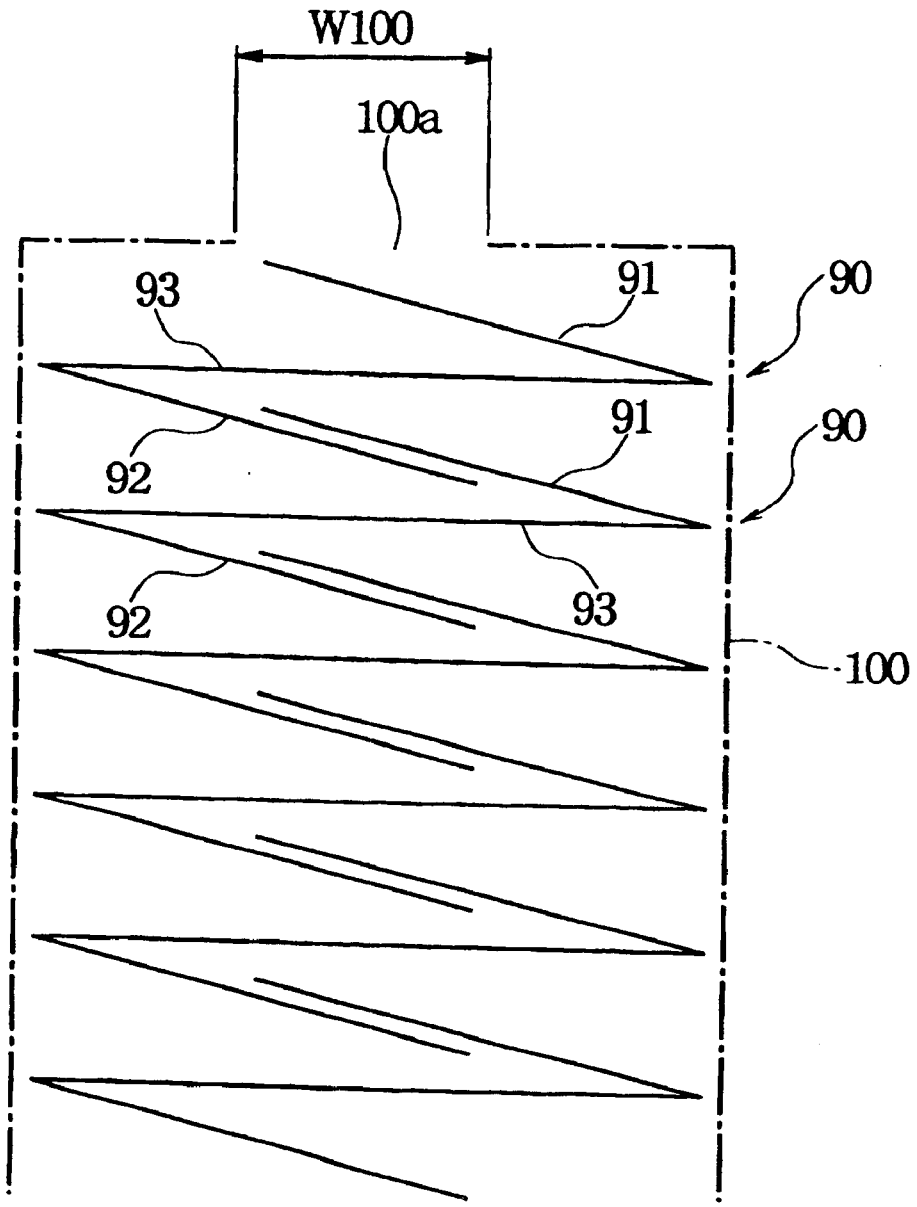
FIG. 7 is a section for explaining another conventional sheet package.

FIG. 5 is a section showing a more preferred modification of the second embodiment of the sheet package according to the invention shown in FIG. 3.

A sheet stack 3 shown in FIG. 5 is basically the same as the embodiment shown in FIGS. 3, 4A and 4B in folding method of respective sheets and the manner of combination of the folded sheets.

In FIG. 5, the first and second four-ply V-folded sheets 20B are combined with placing the first folding line 21 (21A) on left side of the center line O—O in FIG. 5, and placing the first folding line 21 (21B) on right side of the center line O—O in FIG. 5. Thus, the first folding line 21A of the first four-ply V-folded sheet 20B and the first folding line 21B of the first four-ply V-folded sheet 20B are located in the vicinity of the center line O—O without overlapping.

In the embodiment shown in FIG. 5, a length W7 between the shorter edge 20*c* and the second folding line 22 is substantially equal to the length of the upper piece 20B1. The first and second four-ply V-folded sheets 20B as alternately stacked in such a manner that the shorter edges 20*c* of the first four-ply V-folded sheets 20B and the shorter edges 20*c* of the second four-ply V-folded sheets 20B do not overlap at a position in the vicinity of the center line O—O.

Therefore, when number of the first four-ply V-folded sheet 20B and number of the second four-ply V-folded sheet 20B are equal to each other, total numbers of sheets on left side and right side of the center line O—O become equal to each other. For example, as shown in FIG. 5, assuming that three first four-ply V-folded sheets and three second four-ply V-folded sheets are combined, number of sheets on left side and right side becomes fifteen on both sides.

Therefore, the sheet stack 3 becomes flat without causing local bulging.

In the sheet stack 3 shown in FIG. 5, a length W0 of the longer edge 20*a* of the sheet 20 is 190 mm in developed condition, a length W7 of the upper piece 20B1 between the first folding line 21 and the second folding line 22, that is, a length W7 between the second folding line 22 and one shorter edge 20*c* is 40 mm, and a length W8 between the second folding line 22 and the other shorter edge 20*b* is 70 mm. In this case, assuming that the overlapping width W3 of the upper piece 20B1 and the lower piece 20B2 of adjacent first and second four-ply V-folded sheets is 30 mm, the width W30 of the sheet stack 2 becomes 80 mm.

With the present invention, the sheet package according to the present invention hardly causes breakage on the sheet with minimizing damage upon dispensing or withdrawing the sheet through the dispensing opening. Therefore, when the water decomposable sheet is packaged in wet condition or in other occasion, even if the strength of the individual sheet is low, damage of the sheet is hardly caused.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

It should be noted that when the sheet stack is formed by folding the sheet such as wet tissue by a machine, it is inherent to cause tolerance in folding dimension in each individual sheet. Therefore, there is a possibility that the sheet stacks shown in FIGS. 3 and 5 may have some sheets in which the first folding lines 21 or the shorter edges 20*c* extend across the center line O—O. The requirement of the present invention should be satisfied as long as at least some of the sheets are combined or stacked so that the first folding lines 21 or the shorter edges 20*c* do not overlap on the center line O—O.

On the other hand, the present invention is not limited to the sheet package, in which the sheets are packaged in wet condition, but can be the sheet package, in which the sheets are packaged in dry condition. Even in the latter case, by constructing to dispense or withdraw the sheet in two-ply structure, damaging of the sheet can be successfully prevented.

Furthermore, while the present invention has been discussed in terms of preferred embodiments directed to V-folded sheet stack, the present invention should applicable for any type of sheet stacks. For example, the present invention is applicable for sheet stacks disclosed in commonly owned co-pending U.S. Patent Application for "Sheet Package" filed with claiming priority based on Japanese Patent Application No. 2000-304626 and commonly owned co-pending U.S. Patent Application for "Sheet Package" filed with claiming priority based on Japanese Patent Application No. 2000-354195. Disclosure of the above-identified commonly owned co-pending U.S. Patent Applications are herein incorporated by reference.

What is claimed is:

1. A sheet package including a sheet stack, in which a plurality of folded sheets fabricated from water decomposable material and held in a wet condition when contained in said sheet package, are stacked, received within a package container with a dispensing opening, wherein each individual sheet being folded into a two-ply sheet along a first folding line, two sheets of said two-ply sheet being folded along a second folding line extending in parallel to said first folding line together for forming a folded sheet, a plurality of folded sheets being stacked in such a manner that a portion including said first folding line of a lower folded sheet is disposed within a valley folded portion of an upper folded sheet.

2. A sheet package as set forth in claim 1, wherein said sheet stack is formed with placing said first folding line of each folded sheet with a width range of said dispensing opening.

3. A sheet package as set forth in claim 1, wherein said sheet is a water decomposable sheet disposed within said package container in wet condition, said two-ply sheet has a breaking strength less than or equal to 9.8N per 25 mm width in wet condition in a direction perpendicular to said first folding line.

4. A sheet package as set forth in claim 1, wherein said folded sheets in said sheet stack include first folded sheets oriented in one direction and second folded sheets oriented in the other direction, said first and second folded sheets are stacked alternatively in such a manner that said portion including said first folding line of one of said first and second folded sheets located at lower side is disposed within said valley folded portion of the other of said first and second folded sheet located at upper side.

5. A sheet package as set forth in claim 4, wherein said portion including said first folding line of one of said first and second folded sheet located at lower side and said portion including said first folding line of the other of said first and second folded sheet located at upper side do not overlap with each other on a center line extending in sheet stacking direction.

6. A sheet package as set forth in claim 5, wherein said two-ply sheet is formed by folding an essentially rectangular flat one-ply sheet at said first folding line inclined to one of opposite shorter edges so that shorter edges of said two-ply sheet as folded along said first folding line are offset from each other, and two sheet fractions continuous across said first folding line for forming said two-ply sheet have mutually different length in a direction perpendicular to a direction along which said first folding line extends, one of said sheet fraction having shorter length of said first and second folded sheets do not overlap with each other as stacked.

7. A sheet package comprising:

a package container defining a sheet stack receptacle space and a dispensing opening communicated with said sheet stack receptacle space; and a sheet stack containing a plurality of sheets, each individual sheet being a water decomposable sheet disposed within said package container in a wet condition and having a breaking strength less than or equal to 9.8N per 25 mm width when wet in a direction perpendicular to said first folding line, each individual sheet being two-ply sheet and consisting of two sheet fractions that are continuous across a first folding line, a plurality of said two-ply sheets being interfolded with each other in such a manner that when an uppermost sheet is withdrawn through said dispensing opening, a subsequent sheet follows and is separated at said dispensing opening to be retained such that a portion including said first folding line is projected from said dispensing opening so that a portion of the sheet in a two-ply structure is constantly gripped when being withdrawn from said package container.

8. A sheet stack for a sheet package comprising a plurality of sheets, each individual sheet being a water decomposable sheet disposed within said package container in a wet condition and having a breaking strength less than or equal to 9.8N per 25 mm width when wet in a direction perpendicular to said first folding line, each individual sheet being a two-ply sheet consisting of two sheet fractions that are continuous across a first folding line, a plurality of said two-ply sheets being interfolded with each other in such a manner that vertically adjacent sheets are interlinked at a trailing end portion of an upper sheet and a leading end portion of a lower sheet, so that said lower sheet is placed in a position ready for dispensing after dispensing said upper sheet, and said leading end portion includes a leading edge along which said first folding line extends.

9. A sheet package comprising:

a package container defining a sheet stack receptacle space and a dispensing opening communicating with said sheet stack receptacle space; and a sheet stack containing a plurality of sheets fabricated from a water decomposable material and being held in a wet condition when contained in said sheet package, each individual sheet being a two-ply sheet consisting of two sheet fractions that are continuous across a first folding line, a plurality of said two-ply sheets being interfolded with each other in such a manner that when an uppermost sheet is withdrawn through said dispensing opening, a subsequent sheet follows and is separated at said dispensing opening and retained so that a leading edge including said first folding line is projected from said dispensing opening so that a portion of the sheet in a two-ply structure is constantly gripped when being withdrawn from said package container, said leading edges of vertically adjacent sheets being arranged in a non-overlapping manner.

10. A sheet stack for a sheet package comprising a plurality of sheets fabricated from a water decomposable material and being held in a wet condition when contained in said sheet package, each individual sheet being a two-ply sheet consisting of two sheet fractions that are continuous across a first folding line, a plurality of said two-ply sheets being interfolded with each other in such a manner that vertically adjacent sheets are interlinked at a trailing end portion of an upper sheet and a leading end portion of a lower sheet, so that said lower sheet is placed in a position ready for dispensing after dispensing said upper sheet, and said leading end portion includes a leading edge along which said first folding line extends, and said leading end portions of vertically adjacent sheets being arranged in a non-overlapping manner.

* * * * *